United States Patent [19]

Jacobs

[11] Patent Number: 4,791,447

[45] Date of Patent: Dec. 13, 1988

[54] DUAL MODE COLOR FUSER

[75] Inventor: Robert M. Jacobs, Ontario, N.Y.

[73] Assignee: Xerox Corporation, Stamford, Conn.

[21] Appl. No.: 91,466

[22] Filed: Aug. 31, 1987

[51] Int. Cl.[4] ..... G03G 15/20

[52] U.S. Cl. ..... 355/3 FU; 219/216; 432/60

[58] Field of Search ..... 355/3 FU, 4, 14 FU; 219/216; 430/124, 98, 99; 432/60

[56] References Cited

U.S. PATENT DOCUMENTS 4,526,459 7/1985 Bresnick ..... 355/3 FU

*Primary Examiner*—R. L. Moses

[57] ABSTRACT

Heat and pressure fusing apparatus for fixing color toner images to various types of copy substrates. The apparatus includes three roll members which cooperate to form a pair of nips. All substrates pass through a first nip and a deflector plate directs certain types of substrates through the second nip. Passage of the substrates through the first nip causes the images carried thereon to contact a conformable elastomeric surface while passage through the second nip casues them to contact a relatively rigid surface. Thus, glossy and matt color copies on substrates such as plain paper and high chroma transparencies are suitably produced in a color reproduction apparatus incorporating this fuser. Matt color copies are produced by passing the substrate through only the first nip while glossy color copies and high chroma transparencies are produced by passing the substrates through both nips.

13 Claims, 2 Drawing Sheets

DUAL MODE COLOR FUSER

BACKGROUND OF THE INVENTION

This invention relates to an electrostatographic printing machine, and more particularly concerns an apparatus for fusing colored images.

In a typical electrostatographic printing machine, a latent image is recorded on a surface and developed with charged particles. After the latent image is developed, a sheet of support material is positioned closely adjacent thereto so as to receive the particles therefrom. The particles are then permanently affixed to the sheet of support material forming a copy of the original document thereon. Electrographic and electrophotographic printing are differing versions of electrostatographic printing. The process of electrophotographic printing employs a photoconductive member arranged to be charged to a substantially uniform level. The charged photoconductive member is exposed to a light image of an original document. The light image irradiates the charged photoconductive member dissipating the charge in accordance with the intensity of the light transmitted thereto. This records an electrostatic latent image on the photoconductive surface. Electrographic printing differs from electrophotographic printing in that neither a photoconductive member nor a light image of the original document are required to create a latent image on the surface. Both of the foregoing processes generally employ heat settable particles to develop the latent image. The particles are commonly fused to the sheet of support material by the application of heat and pressure thereto.

Various techniques have been developed for applying heat to the particles on the sheet of support material. One technique is to pass the sheet of support material with the powder image thereon through a pair of opposed rollers. In one such system, a heated fuser roll and a non-heated backup roll are employed.

In the most commonly employed type of heated roll fuser, the heated fuser roll has the outer surface thereof covered with a polytetrafluoroethylene commonly known as Teflon to which a release agent such as silicone oil is applied. The Teflon layer, preferably, has a thickness of about several mils.

More recently fuser systems have been utilizing silicone rubber and Viton (Trademark of E. I. dupont) coated fuser rolls for contacting the toner images to thereby enhance copy quality, that is to say, perceived copy quality.

Bare roll fusers while not commercially accepted have been making inroads, at least in the patent literature.

Heretofore, no single roll fuser like those discussed above or for that matter no device utilizing a single fuser structure of any type has been produced which satisfactorily fuses colored images on various substrates.

The problem of fusing colored images is addressed in U.S. Pat. No. 4,223,203 wherein there is disclosed a heat and pressure fusing apparatus for fixing toner images to copy substrates comprising a first fusing system consisting of a pair of nip forming rolls, one of which is provided with a conformable outer surface and a second fusing system consisting of a pair of nip forming rolls, one of which has a rigid outer surface. Copy substrates are passed sequentially through the nips of the first and second fusing systems, in that order such that the toner images sequentially contact the conformable outer surface and then the rigid outer surface.

The fusing of color images has been accomplished commercially in a copier wherein a radiant fuser for opaque copies and a post vapor fusing process for transparencies are employed. Such a system is expensive as is the two fuser arrangement of the U.S. Pat. No. 4,223,203. Additionally, the radiant and post vapor arrangement is not capable of producing glossy color copies.

While not specifically addressing the problems of fusing colored images, other patents such as U.S. Pat. No. 3,965,331 utilize multiple fuser structures. The U.S. Pat No. 3,965,331 discloses a contact fuser assembly for use in an electrostatic reproducing apparatus wherein toner images are formed on various types of substrates, for example, plain paper and transparency materials such as cellulose acetate or polyester film. The fuser assembly is characterized by a provision of three fuser rolls forming a pair of nips through which the substrates pass in order to fuse the toner images thereto. Transport mechanism is provided for conveying the substrates to one or the other of the nips depending upon the particular material of the substrate. The surface of the roll provided for contacting the plain paper comprises a hard metal surface and the roll for contacting the toner images carried by the cellulose acetate, etc. comprises an elastomeric surface.

Other patents which contain teachings that may be relevant to the instant invention are U.S. Pat. Nos. 3,566,076; 3,679,302; 3,861,863; 4,526,459; 4,627,813 and 4,639,405 the former which relates to a method and apparatus for fixing toner images in which a copy sheet bearing unfixed toner is first passed through a pair of heated fuser rollers and is subsequently passed through surfacing rollers to provide a gloss to the toner image. In order to prevent curling of the copy sheet and blistering of the glossed image, the copy sheet is passed through a conditioner means, located between the fuser rollers and the surfacing rollers, for removing a substantial portion of the moisture from the copy sheet.

U.S. Pat. No. 4,627,813 discloses a thermal fixing apparatus for use with a copying machine or electronic printer in which an operating temperature of the apparatus after energization is quickly reached. A pair of fixing rolls is provided, at least one of which is heated. The outer surface of the other is covered with an elastically deformable outer layer. The two rolls are pressed into abutment with one another to form a nip therebetween of the predetermined width. A plate-shaped heater element is disposed prior to the nip adjacent the path of conveyance of toner-image-bearing paper sheets to be fixed. The plane of the heater element is preferably parallel to the plane of the paper. The surface temperature of the heater element has a temperature higher at central portions than at widthwise ends thereof to provide uniform fixing conditions.

U.S. Pat. No. 3,861,863 discloses a black and white image fuser comprising a first stage backside heater and a second stage soft roll fuser.

U.S. Pat. No. 3,679,302 discloses first and second stage radiant fusers.

U.S. Pat. No. 3,566,076 discloses the combination of radiant and pressure fusing.

U.S. Pat. No. 4,526,459 discloses a heat and pressure fuser including a heated fuser roll and two pressure rolls which cooperate to form two nips. Copy substrates are passed through one or the other of the two nips depending on the path of travel of the copy substrate. Thus, when the substrate moves along a first path it passes through one of the nips and when it moves along a second path it passes through the other of the nips.

For a color copier to find total acceptance in the market place it is necessary that it be able to reproduce glossy or matt opaque copies and high chroma transparencies. Moreover, it is necessary that it be able to do so without increasing the cost of the copying machine to the customer and without utilizing excessive space in the machine. Chroma refers to the quality of the projected images by the transparency. In other words, the colors of a projected transparency represent a faithful reproduction of the colors of the original images.

BRIEF SUMMARY OF THE INVENTION

In accordance with the present invention, the shortcomings of prior art devices as noted above have been overcome as will be disclosed hereinbelow in greater detail. By the present disclosure, I provide the knowledge required to produce a color copies capable of generating glossy or matt color copies on a substrate such as plain paper and high chroma transparencies.

To this end, there is provided a heat and pressure roll fuser comprising a pair of rolls capable of producing acceptable matt color copies when the copies are passed therethrough. For the production of glossy color copies and high chroma transparencies a third roll is provide which cooperates with one of the two aforementioned rolls to form a second nip through which these substrates are moved after having first passed between the pair of rolls. This third roll is preferably a hard polished roll of either copper or aluminum which is heated. The dwell time of the second nip, its operating temperature and pressure in the nip are such that toners of the image are adequately melted and smoothed to the degree necessary to produce acceptable high gloss color images and high chroma transparencies.

A deflector bar is automatically moved between two operative positions to thereby effect movement of copy substrates through the first nip or through the first and second nips. Positioning of the deflector bar is accomplished by the operator through the selection of one or the other of two switches on a control panel which are suitably labeled for identifying which type of copies are to be produced.

DETAILED DESCRIPTION OF THE PREFERRED EMBODIMENT OF THE INVENTION

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
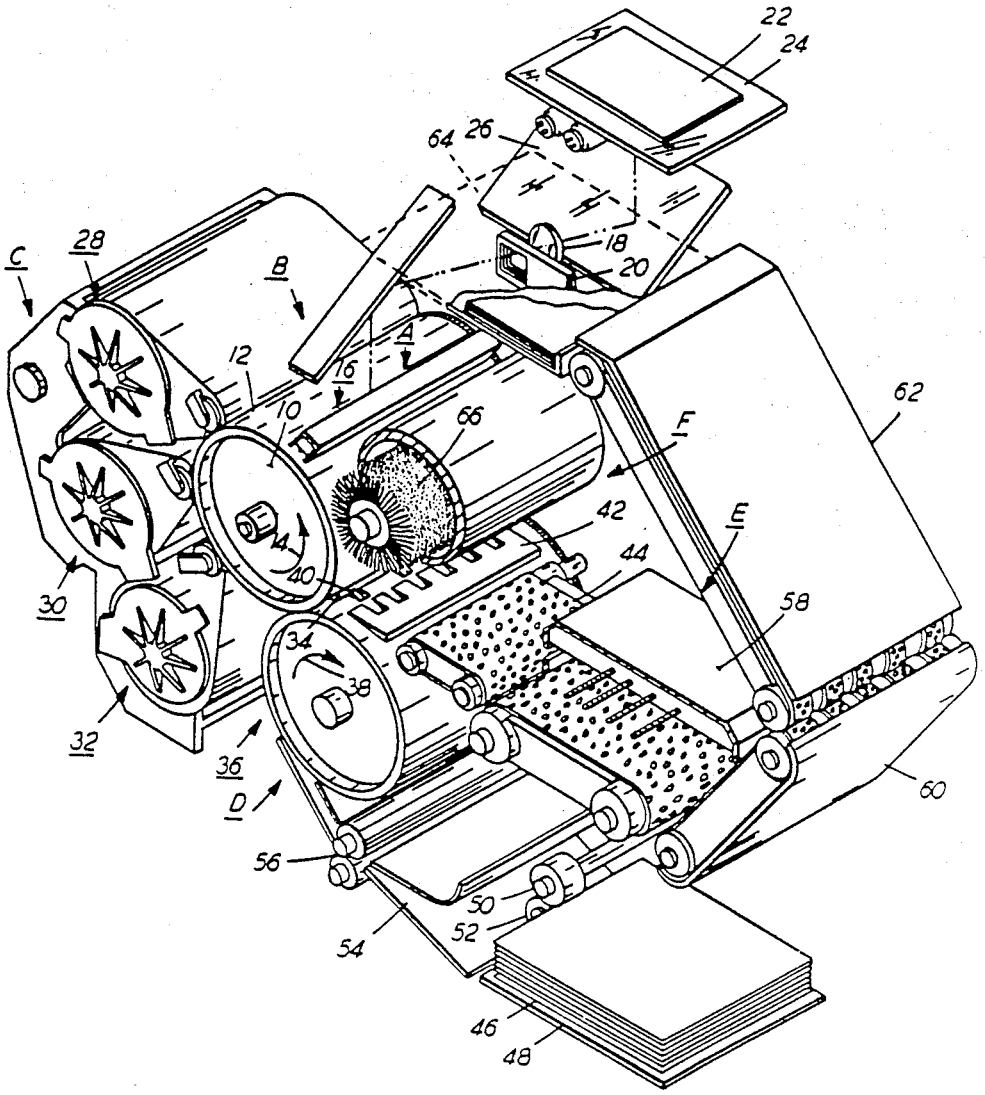
FIG. 1 is a perspective view of a prior art electrophotographic printing machine in which the present invention may be utilized.

For a general understanding of the features of the present invention, reference is made to the drawing. FIG. 1 schematically depicts the various components of an illustrative electrophotographic printing machine incorporating the fusing system of the present invention therein. It will become evident from the following discussion that the fusing system described hereinafter is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the multi-color electrophotographic printing machine employs a photoconductive member, such as a rotatably mounted drum 10 having a photoconductive surface 12 entrained about the circumferential surface thereof. Preferably, photoconductive surface 12 is formed from a material having a relatively panchromatic response to white light. By way of example, photoconductive surface 12 may be made from a selenium alloy deposited on a conductive substrate, such as aluminum. Drum 10 rotates in the direction of arrow 14 to pass through the various processing stations disposed thereabout.

Initially, photoconductive surface 12 passes through charging station A which has positioned thereat a corona generating device indicated generally by the reference numeral 16. Corona generating device 16 charges photoconductive surface 12 to a relatively high, substantially uniform potential.

Thereafter, the charged portion of photoconductive surface 12 is advanced through exposure station B. Exposure station B includes a moving lens system, generally designated by the reference numeral 18, and a color filter mechanism shown generally at 20. An original document 22 is stationarily supported upon a transparent viewing platen 24. This enables successive incremental areas of original document 22 to be illuminated by moving lamp assembly 26. Lamp assembly 26 and lens system 18, as well as filter mechanism 20, move in a timed relationship with drum 10 to scan successive incremental areas of original document 22 disposed upon platen 24. In this manner, a flowing light image of original document 22 is projected onto charged photoconductive surface 12. The charge on photoconductive surface 12 is selectively dissipated in accordance with the light intensity projected thereon. Filter mechanism 20 is adapted to interpose selected color filters into the optical light path. The appropriate color filter operates on the light rays passing through lens 18 to record an electrostatic latent image on photoconductive surface 12 corresponding to a pre-selected spectral region of the electromagnetic wave spectrum, hereinafter referred to as a single color electrostatic latent image.

After exposure, drum 10 rotates the single color electrostatic latent image recorded on photoconductive surface 12 to development station C. Development station C includes three developer units generally indicated by the reference numerals 28, 30, and 32, respectively. Developer units 28, 30, and 32 are all of the type generally referred to as magnetic brush developer units. In a magnetic brush developer unit, a magnetized developer mix having carrier granules and toner particles is continually brought through a directional flux field to form a brush of developer material. The developer mix is continually moving to provide fresh developer mix to the brush. Preferably, the brush in the magnetic brush system comprise a magnetic member with a mass of developer mix adhering thereto by magnetic attraction. The developer mix includes carrier granules having toner particles clinging thereto by triboelectric attraction. This chain-like arrangement of developer mix stimulates the fibers of a brush. Development is achieved by bringing the brush of developer mix into contact with photoconductive surface 12. Each of the developer units 28, 30 and 32, respectively, apply toner particles to photoconductive surface 12 which are adapted to absorb light within a pre-selected spectral region of the electromagnetic wave spectrum corresponding to the wavelength of light transmitted through filter 20. For example, an electrostatic latent image formed by passing the light image through a green filter will record the red and blue regions of the spectrum as areas of relatively high charge density on photoconductive surface 12, or the green light rays will pass through the filter and cause the charged density on photoconductive surface 12 to be reduced to a voltage level substantially ineffective for development. The charged areas are then made visible by applying green absorbing (magenta) toner particles to the electrostatic latent image recorded on photoconductive surface 12. Similarly, a blue separation is developed with blue absorbing (yellow) toner particles, while a red separation is developed with red absorbing (cyan) toner particles. The detailed structure of the developer units will be described hereinafter with reference to FIGS. 2 and 3.

After development, the now visible toner powder image is moved to transfer station D. At transfer station D, the toner powder image is transferred to a sheet of final support material 34, such as plain paper, amongst others, by means of a transfer drum, shown generally at 36. Transfer drum 36 rotates in the direction of arrow 38 and is adapted to have support material 34 secured releasably thereto so as to be recirculated therewith. The surface of transfer drum 36 is electrically biased to a potential having a sufficient magnitude and the proper polarity to electrostatically attract toner particles from photoconductive surface 12 to support sheet 34. Inasmuch as support material 34 is secured releasably on transfer drum 36, successive toner powder images may be transferred thereto in superimposed registration with one another as drum 36 rotates through successive cycles. After the last transfer operation, support sheet 34 is stripped from transfer drum 36. Gripper finger 40 space support sheet 34 from drum 36 and stripper bar 42 is interposed therebetween. In this manner, support sheet 34 is separated from transfer drum 36. Thereafter, endless belt conveyor 44 advances support sheet 34 to fusing station E.

With continued reference to FIG. 1, a stack of 46 of sheets 34 is disposed on tray 48. Feed roll 50, cooperating with the retard roll 52, advances successive uppermost sheets 34 from stack 46 into chute 54. Chute 54 guides the advancing sheet into the nip between register rolls 56. Register rolls 56 align the sheet and forward it, in registration with gripper fingers 40, to transfer drum 36. The sheet is secured to transfer drum 36 for recirculation therewith as hereinbefore described.

After the toner powder images have been transferred to support material 34, support material 34 is removed from drum 36 and advanced to fuser 58 which permanently affixes the transferred powder image thereto. After the fusing process, support material 34 is advanced by endless belt conveyor 60 and 62 to catch tray 64 for subsequent removal from the printing machine by the operator.

Although a preponderance of the toner particles are transferred to support material 34, invariably some residual toner particles remain on photoconductive surface 12. These residual toner particles are removed from photoconductive surface 12 as it moves through cleaning station E. The residual toner particles are initially brought under the influence of a cleaning corona generating device (not shown) which neutralizes the electrostatic charge remaining on photoconductive surface 12. The neutralized toner particles are then cleaned from photoconductive surface 12 by a rotatably mounted fibrous brush 66 in contact therewith.

It is believed that the foregoing description is sufficient for purposes of the present invention to illustrate the general operation of an electrophotographic printing machine embodying the teachings of the present invention therein.

Figure 2:
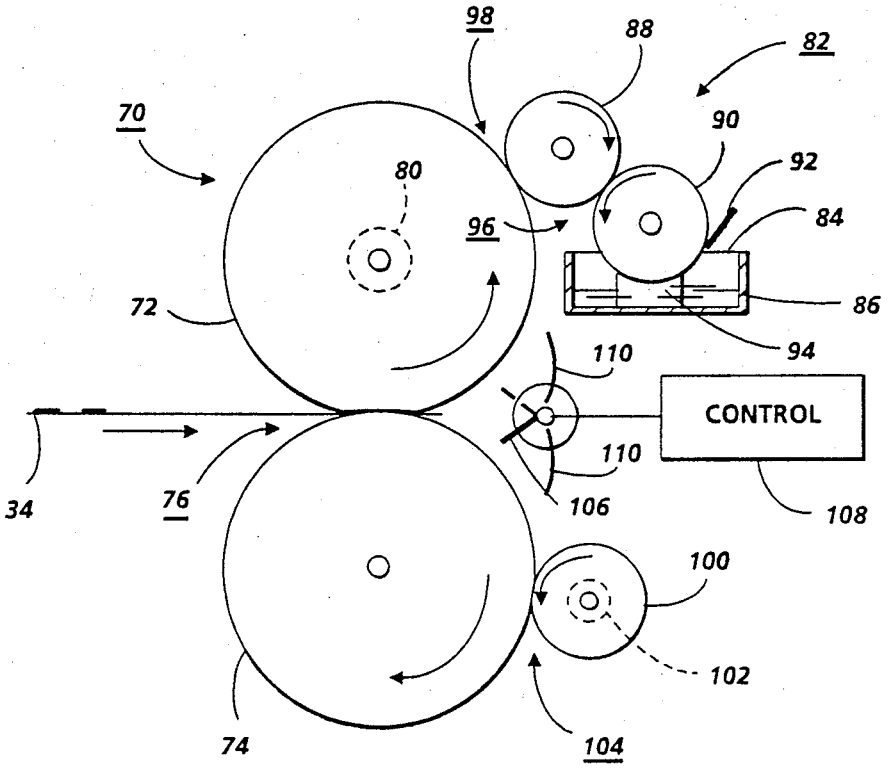
FIG. 2 is a schematic view of a fusing apparatus representing the invention.

Referring now to FIG. 2, there is shown a side elevational view, schematically depicted, of a heat and pressure fuser 70 representing the present invention. As illustrated therein, the fuser 70 comprises a heated fuser roll structure 72 and a pressure roll structure 74. The roll structures 72 and 74 are supported in pressured engagement, in a well known manner, to thereby create a first nips 76 through which copy substrates 34 are moved with the toner images carried thereby contacting the surface of the heated fuser roll structure 72.

Each of the roll structures 72 and 74 are provided with a layer of Viton which has a thickness of approximately 0.020 inch. The roll structure 72 is internally heated by a suitable heat lamp 80 which may be a quartz heating element. The heat output from the lamp 80 is capable of raising the surface temperature of the fuser roll to the required fusing level. Such temperature is in the order of 365°–400° F. Nip pressure is in the order of 80 to 120 psi and the dwell time is in the order of 25–40 milliseconds.

A release agent management (RAM) system generally indicated by reference character 82 is provided for applying a liquid release agent material 84 contained in sump 86 to the fuser roll structure 72. The RAM 82 comprises a donor roll 88, metering roll 90, doctor blade 92 and a wick 94.

The metering roll 90 is partially immersed in the release agent material 84 and is supported for rotation such that it is contacted by the donor roll 88 which, in turn, is supported so as to be contacted by the heated roll structure 72. As can be seen, the orientation of the rolls 88 and 90 is such as to provide a path for conveying material 84 from the sump 86 to the surface of the heated roll structure 17. The metering roll is preferably a steel-surfaced roll having a 4–32 AA finish. The metering roll has an outside diameter of 0.75 inch. As mentioned above, the metering roll is supported for rotation, such rotation being derived by means of the positively driven heated roll structure 72 via the rotatably supported donor roll 88. In order to permit rotation (at a practical input torque to the heated roll structure 72) of the metering roll 90 in this manner the donor roll 88 comprises a deformable layer which forms a nip 96 between the metering roll and the donor roll and a nip 98 between the latter and the heated roll 72. The nips also permit satisfactory release agent transfer between the rolls and roll structure. Suitable nip lengths are 0.10 inch.

The wick 94 is immersed in the release agent 84 and contacts the surface of the metering roll 90. The purpose of the wick is to provide an air seal which disturbs the air layer formed at the surface of the roll 90 during rotation thereof. If it were not for the function of the wick, the air layer would be coextensive with the surface of the roll immersed in the release agent thereby precluding contact between the metering roll and the release agent.

The doctor blade 92 is preferably fabricated from Viton is $\frac{3}{4}\times\frac{1}{8}$ in cross section and has a length coextensive with the metering roll. The edge of the blade contacting the metering roll has a radius of 0.001–0.010 inch. The blade functions to meter the release agent picked up by the roll 90 to a predetermined thickness, such thickness being of such a magnitude as to result in several microliters of release agent consumption per copy.

The donor roll 88 has an outside diameter of 0.813 inch when the metering roll's outside diameter equals 0.75 inch. It will be appreciated that other dimensional combinations will yield satisfactory results. For example, 1.5 inch diameter rolls for the donor and metering rolls have been employed. The deformable layer of the donor roll preferably comprises silicone rubber. However, other materials may also be employed.

A thin sleeve on the order of several mils, constitutes the outermost surface of the roll 88, the sleeve material comprises Teflon. While the donor roll may be employed without the sleeve, it has been found that when the sleeve is utilized, contaminants such as lint on the heated roll 72 will not readily transfer to the metering roll 90. Accordingly, the material in the sump will not become contaminated by such contaminants.

A second heated roll structure 100 is preferably a polished metal roll fabricated from copper or aluminum or other suitable rigid and heat conducting material. Alternatively the roll structure 100 may comprise a metal core with a layer of Viton or other suitably elastomeric material adhered thereto. A heat lamp 102 disposed internally of the structure 100 serves to elevate its temperature to an operating value in the order of 320°–370° F. The structure 100 is supported at approximately the 3 o'clock position relative to the roll structure 74 in pressure engagement therewith during a fusing operation such that a pressure in a nip 104 in the order of 20–100 psi is attained simultaneously with a nip dwell time in the order of 10–35 milliseconds.

A deflector bar 106 supported adjacent the exit of the nip 76 serves to alter the path of travel of the copy substrate when certain substrates are being fused. When the deflector bar is interposed (i.e. dotted-line position) in the path of the substrate as it exits from the nip 76, the substrate is forced to pass through the nip 104 in addition to the nip 76. In its inoperative (i.e. solid-line position) position as shown in FIG. 2, the deflector bar does not alter the direction of travel of the copy substrate, therefore, the copy substrate only passes through the nip 76.

In operation, substrates such as plain paper with color images thereon are passed solely through the nip 76 which results in fused images that have a matt or dull finish or appearance. On the other hand, if these same substrates are also passed through the nip 104 the fused images take on a glossy appearance. Accordingly, the operator has a choice as to how color images on plain paper substrates appear. To produce high chroma transparencies the substrates are always passed through both of the fusing nips 76 and 104. A control 108 serves to position the deflector bar 106 in one of its two operative positions. The plate is normally biased into the position shown by the solid line and is moved to the dotted line position by the control 108. Thus, upon actuation of a button (not shown), the deflector bar is repositioned from the position which alters the path of travel of the substrate so that it passes through both nips. A pair of guides 110 guide the substrate along its path.

In view of the foregoing description, it should now be apparent that there has been provided for use in an electrophotographic reproduction apparatus a heat and pressure fuser capable of producing glossy or shiny color copies, matt or dull color copies and high chroma transparencies.

What is claimed is:

1. Heat and pressure fuser apparatus for fixing toner images to copy substrates utilizing two roll structures forming first and second nips with a third roll structure, the improvement comprising:

means for effecting movement of copy substrates through either said first nip or said first and second nips in accordance with the type of copies that are to be reproduced, said movement effecting means comprising a deflector member movable to first and second positions, said deflector member serving to alter the direction of movement of a copy substrate when in one of said positions whereby copy substrates are moved through both of said nips.

2. Apparatus according to claim 1 including means for controlling the movement of said deflector member from said first position to said second position.

3. Apparatus according to claim 2 wherein said movement controlling means is user actuated.

4. Apparatus according to claim 3 wherein said movement controlling means comprises a control button located on a control panel of a reproduction apparatus in which said fuser is utilized.

5. Apparatus for forming toner images on a charge retentive surface with subsequent transfer to copy substrates, said apparatus comprising:

a heat and pressure fuser apparatus for fixing toner images to copy substrates utilizing two roll structures forming first and second nips with a third roll structure, said fuser apparatus including means for effecting movement of copy substrates through either said first nip or said first and second nips in accordance with the type of copies that are to be reproduced, said movement effecting means comprising a deflector member movable to first and second positions, said deflector member serving to alter the direction of movement of a copy substrate when in one of said positions whereby copy substrates are moved through both of said nips.

6. Apparatus according to claim 5 including means for controlling the movement of said deflector member from said first position to said second position.

7. Apparatus according to claim 6 wherein said movement controlling means is user actuated.

8. Apparatus according to claim 7 wherein said movement controlling means comprises a control button located on a control panel of a reproduction apparatus in which said fuser is utilized.

9. Heat and pressure fuser apparatus for fixing toner images to copy substrates utilizing two roll structures forming first and second nips with a third roll structure, the improvement comprising:

means for effecting movement of color images to produce a matt finish through only one of said nips and color images to produce a glossy finish and transparencies through both of said nips.

10. Apparatus according to claim 9 wherein said movement effecting means comprises a deflector member movable to first and second positions, said deflector member serving to alter the direction of movement of a copy substrate when in one of said positions whereby copy substrates are moved through both of said nips.

11. Apparatus according to claim 10 including means for controlling the movement of said deflector member from said first position to said second position.

12. Apparatus according to claim 11 wherein said movement controlling means is user actuated.

13. Apparatus according to claim 12 wherein said movement controlling means comprises a control button located on a control panel of a reproduction apparatus in which said fuser is utilized.

* * * * *